US009556763B2

(12) United States Patent
Kwak et al.

(10) Patent No.: US 9,556,763 B2
(45) Date of Patent: Jan. 31, 2017

(54) VARIABLE VALVE LIFT APPARATUS

(71) Applicant: Hyundai Motor Company, Seoul (KR)

(72) Inventors: Young Hong Kwak, Suwon-si (KR); Won Gyu Kim, Seoul (KR); Gyu Han Hwang, Yongin-si (KR); Jin Hwa Kim, Ulsan (KR); Gee Wook Shin, Gunpo-si (KR); Myungsik Choi, Seoul (KR); Jin Kook Kong, Suwon-si (KR)

(73) Assignee: Hyundai Motor Company, Seoul (KR)

( * ) Notice: Subject to any disclaimer, the term of this patent is extended or adjusted under 35 U.S.C. 154(b) by 204 days.

(21) Appl. No.: 14/448,731

(22) Filed: Jul. 31, 2014

(65) Prior Publication Data

US 2015/0167510 A1 Jun. 18, 2015

(30) Foreign Application Priority Data

Dec. 17, 2013 (KR) ..... 10-2013-0157577

(51) Int. Cl.
*F01L 1/18* (2006.01)
*F01L 13/00* (2006.01)

(52) U.S. Cl.
CPC ..... *F01L 13/0031* (2013.01)

(58) Field of Classification Search
CPC ..... F01L 9/021; F01L 9/025; F01L 9/023; F01L 1/245; F01L 1/143
USPC ..... 123/90.12
See application file for complete search history.

(56) References Cited

U.S. PATENT DOCUMENTS

2009/0320780 A1* 12/2009 Sundsten ..... F01L 1/16 123/90.55
2011/0132297 A1* 6/2011 Cho ..... F01L 1/143 123/90.12
2012/0067313 A1* 3/2012 Choi ..... F01L 13/0031 123/90.16

FOREIGN PATENT DOCUMENTS

JP 2003-013717 A 1/2003
KR 10-0507208 B1 8/2005
KR 10-1154412 B1 6/2012
KR 101251818 B1 4/2013

* cited by examiner

*Primary Examiner* — Zelalem Eshete
(74) *Attorney, Agent, or Firm* — Morgan, Lewis & Bockius LLP

(57) ABSTRACT

A variable valve lift apparatus may include an outer body, an inner body inserted in the outer body to move up and down in the outer body, a valve cylinder inserted in the outer body on a lower side of the inner body to have one side coupled to the inner body and the other side coupled to the valve, a latching member provided either to the outer body or to the inner body to be operated by a hydraulic pressure for coupling to the outer body and the inner body selectively, a hydraulic chamber formed between the outer body and the inner body, a latching flow passage formed in the outer body to supply the hydraulic pressure to the latching member, and an oil removal valve provided to drain a fluid.

7 Claims, 4 Drawing Sheets

VARIABLE VALVE LIFT APPARATUS

CROSS-REFERENCE TO RELATED APPLICATION

The present application claims priority to and the benefit of the Korean Patent Application No. 10-2013-0157577 filed on Dec. 17, 2013, the entire contents of which is incorporated herein for all purposes by this reference.

BACKGROUND OF THE INVENTION

Field of the Invention

The present invention relates to a variable valve lift apparatus. More particularly, the present invention relates to a variable valve lift apparatus of which operation stability is secured.

Description of Related Art

In general, an engine is provided with a combustion chamber for burning fuel to generate power, an intake valve to be opened and closed for selective supply of combustion chamber mixture gas, and an exhaust valve to be opened and closed for selective exhaust of exhaust gas.

The intake valve and the exhaust valve are opened and closed by a valve opening and closing device connected to a crankshaft for intaking the mixture gas and exhausting the exhaust gas, respectively.

A related art valve opening and closing device is operated by a cam of a fixed shape to open the valve to a fixed lift always, without changing timing or a valve lift of intake and exhaust. Consequently, appropriate intake and exhaust cannot be performed according to an operation state of the engine.

For an example, if a valve mechanism has been designed suitable for a low speed operation state, adequate mixture gas may not be supplied to the combustion chamber and exhaust from the combustion chamber may not be smooth in a high speed operation state when a relatively high output is required. And, if the valve mechanism has been designed suitable for the high speed operation state, excessive mixture gas may be supplied to the combustion chamber and an exhaust time period from the combustion chamber may be long excessively in the low speed operation state.

Recently, in order to solve such a problem, researches on a variable valve lift apparatus undergo, actively.

However, if the variable valve lift apparatus is operated only by a hydraulic pressure, smooth operation of the variable valve lift apparatus may become difficult as viscosity of the oil of the hydraulic pressure increases when an engine temperature becomes low which results in a low temperature of the oil.

The information disclosed in this Background of the Invention section is only for enhancement of understanding of the general background of the invention and should not be taken as an acknowledgement or any form of suggestion that this information forms the related art already known to a person skilled in the art.

BRIEF SUMMARY

Various aspects of the present invention are directed to providing variable a valve lift apparatus having advantages of able to make stable operation even if a temperature of oil becomes low.

Accordingly, an object of the present invention, created for solving above problem, is to provide a variable valve lift apparatus which can make stable operation even if a temperature of oil becomes low.

In an aspect of the present invention, a variable valve lift apparatus may include an outer body coupled to a cylinder head arranged between a cam and a valve, an inner body inserted in the outer body to move up and down in the outer body according to rotation of the cam, a valve cylinder inserted in the outer body on a lower side of the inner body to have a first side coupled to the inner body and a second side coupled to the valve for moving up and down on an inside of the outer body, a latching member provided either to the outer body or to the inner body to be operated by a hydraulic pressure for selectively coupling to the outer body and the inner body, a hydraulic chamber formed between the outer body and the inner body and moving the inner body as much as a stroke of a lift of the cam with a hydraulic pressure, a latching flow passage formed in the outer body to supply the hydraulic pressure to the latching member, and an oil removal valve provided to drain a fluid from a space formed between the outer body and the valve cylinder or the inner body depending on a shape of the inner body or the valve cylinder at a time the inner body or the valve cylinder moves up and down.

The oil removal valve may include a supporting portion mounted to the outer body, an active portion formed to have a column shape with an upper end, a lower end and a side provided to a top side of the supporting portion to be movable up and down, a return spring supported by the supporting portion arranged between the supporting portion and the active portion for pushing the active portion upward, a bypass flow passage formed in the active portion to have a first end opened to the lower end of the active portion, and a second end opened to the side of the active portion, an active flow passage formed in the outer body to make the latching flow passage and the upper end of the active portion to be in communication, a flow out flow passage formed in the outer body to be in communication with the space and in communication with the bypass flow passage, selectively, and a recovery flow passage formed in the outer body to be in communication with the hydraulic chamber and in communication with the bypass flow passage, selectively.

The flow out flow passage and the recovery flow passage are closed when the upper end of the active portion is pushed by the hydraulic pressure supplied from the active flow passage.

The upper end of the active portion may have the hydraulic pressure supplied thereto from the active flow passage when the hydraulic pressure is supplied to the latching flow passage.

When the hydraulic pressure being supplied to the active portion is removed, the active portion is returned to an original position by the return spring.

When the active portion is returned to the original position, the flow out flow passage and the recovery flow passage become in communication with the bypass flow passage.

The flow out flow passage becomes in communication with a space between the active portion which is to become in communication with the first end of the bypass flow passage and the supporting portion.

The recovery flow passage becomes in communication with the second end of the bypass flow passage.

Thus, in a case the engine temperature is low, operation reliability and stability can be enhanced.

And, operation responsiveness can be improved and smooth opening and closing of the valve 7 can be embodied.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
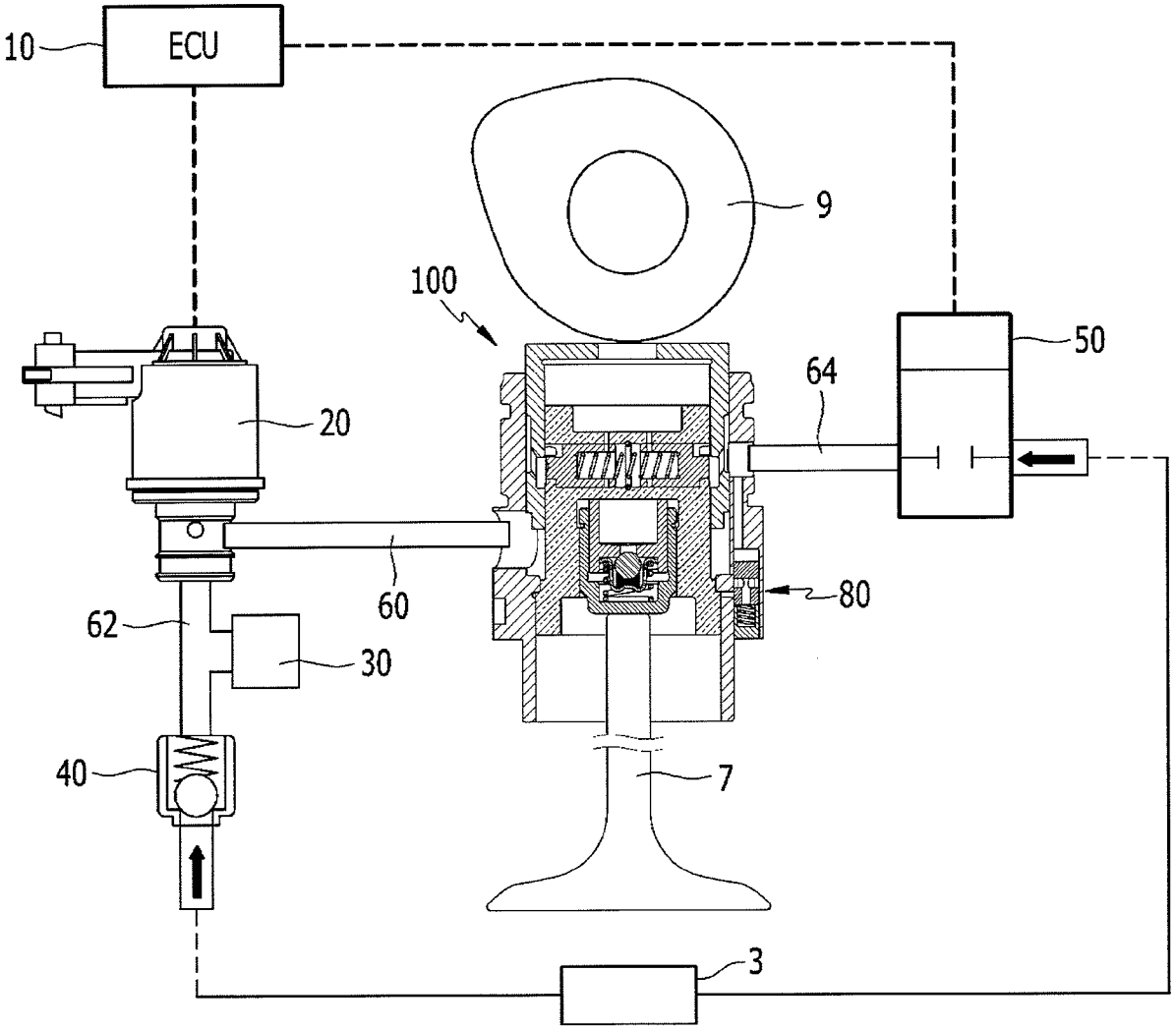
FIG. 1 illustrates an operation circuit diagram of a variable valve lift apparatus in accordance with an exemplary embodiment of the present invention.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

Figure 2:
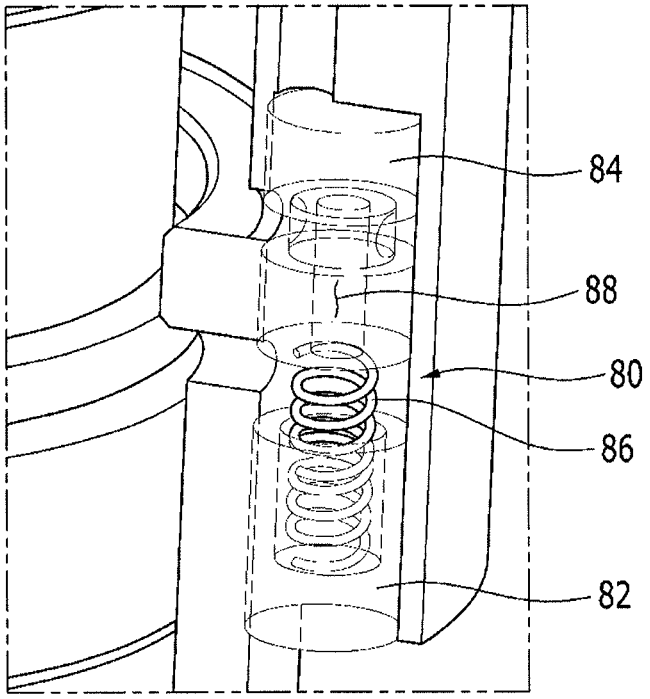
FIG. 2 illustrates an enlarged perspective view of an oil removal valve in accordance with an exemplary embodiment of the present invention.
Figure 3:
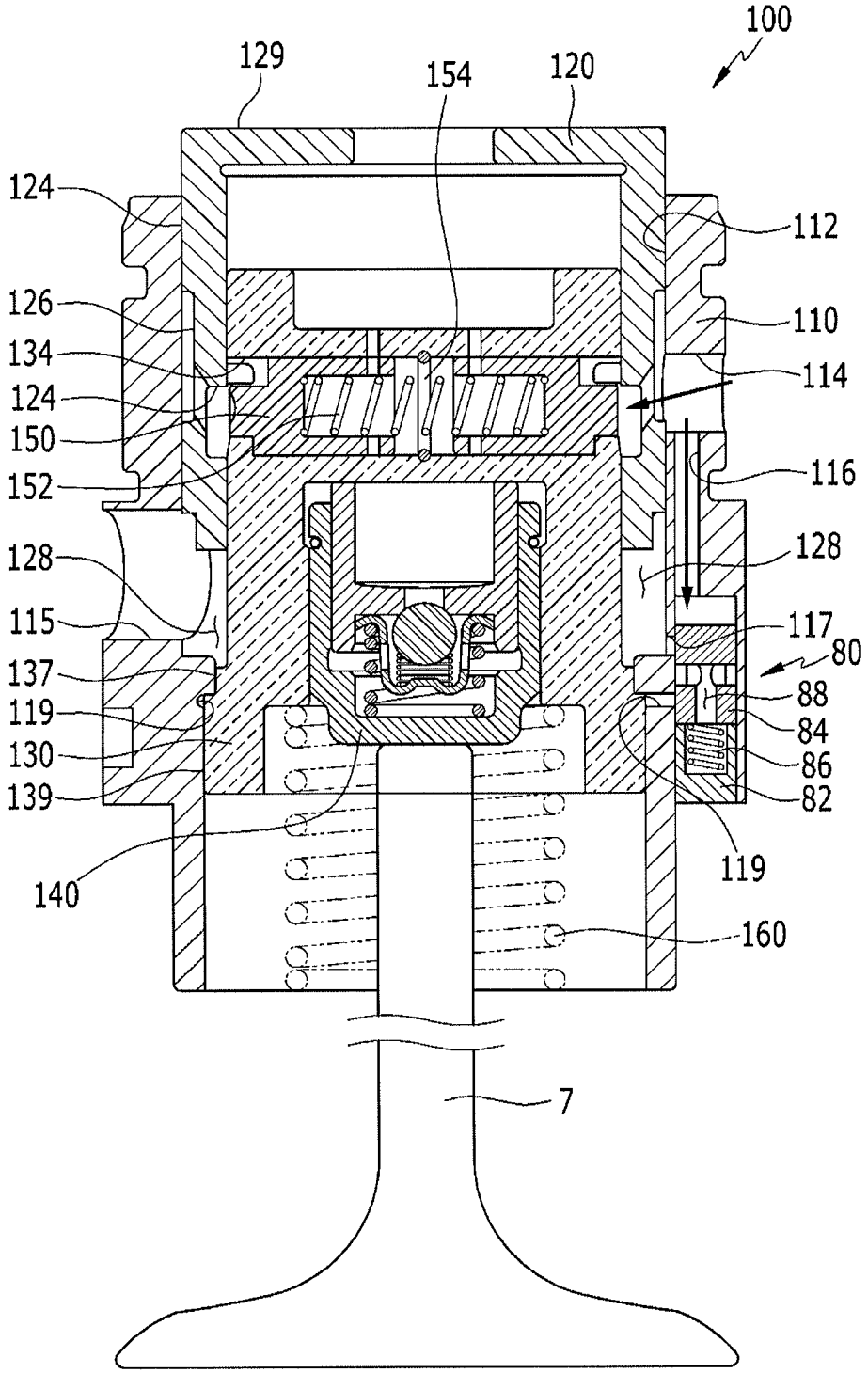
FIG. 3 illustrates a cross-sectional view of an oil removal valve in accordance with an exemplary embodiment of the present invention, showing an operation state thereof.
Figure 4:
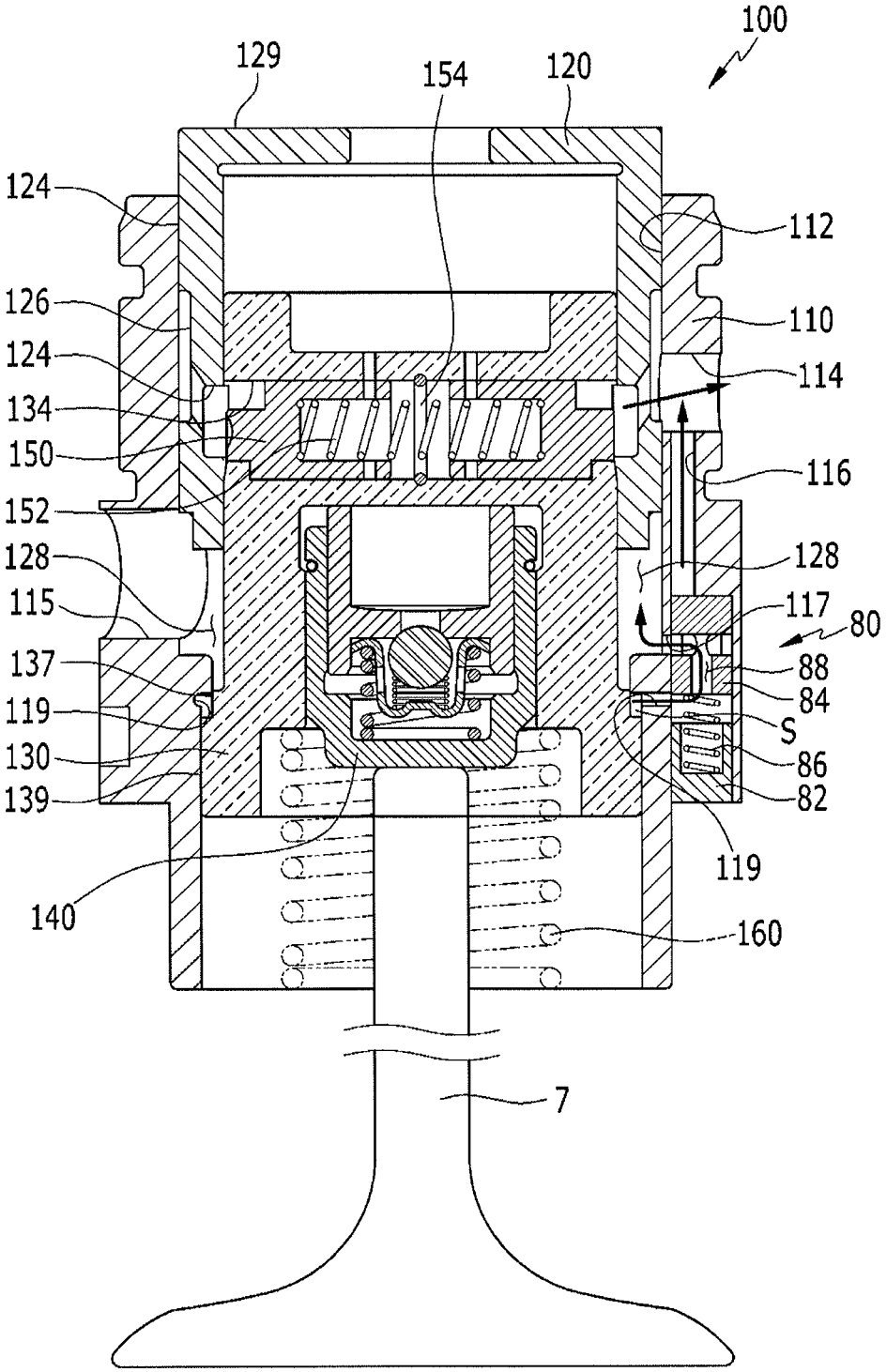
FIG. 4 illustrates a cross-sectional view of an oil removal valve in accordance with an exemplary embodiment of the present invention, showing an original position state thereof It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

FIG. 1 illustrates an operation circuit diagram of a variable valve lift apparatus in accordance with an exemplary embodiment of the present invention, FIG. 2 illustrates an enlarged perspective view of an oil removal valve in accordance with an exemplary embodiment of the present invention, FIG. 3 illustrates a cross-sectional view of an oil removal valve in accordance with an exemplary embodiment of the present invention, showing an operation state thereof, and FIG. 4 illustrates a cross-sectional view of an oil removal valve in accordance with an exemplary embodiment of the present invention, showing an original position state thereof.

The variable valve lift apparatus 100 in accordance with an exemplary embodiment of the present invention is coupled to a cylinder head of an engine. And, the variable valve lift apparatus 100 controls an opening or a closing of a valve 7 according to rotation of a cam shaft. Moreover, the variable valve lift apparatus 100 includes a body 110, 120, a valve cylinder 130, a latching member 150, 152, 154, and a hydraulic chamber 128.

The body 110, 120 has an outer body 110 coupled to, and secured to, the cylinder head, and an inner body 120 coupled to an inside of the outer body 110 slidably inserted therein. In this case, the outer body 110 may be formed as one unit with the cylinder head, if required.

The outer body 110 has a latching flow passage 114 and a hydraulic chamber flow passage 115 in communication thereto for having a working fluid of a constant pressure supplied thereto from a hydraulic pressure supply unit 3. And, the outer body 110 has a sliding surface 112 formed on an inside of the outer body 110 for sliding of the inner body 120 thereon. Moreover, the sliding surface 112 has an upper side for guiding sliding of the inner body 120 and a lower side for guiding sliding of the valve cylinder 130.

In the meantime, in an upper side of an inside of the outer body 110, the hydraulic chamber 128 is constructed of a lower side of the inner body 120 and a side of the valve cylinder 130 in communication with the hydraulic chamber flow passage 115, and the hydraulic chamber 128 is extended to a lower side of the inside of the outer body 110. And, the hydraulic chamber 128 may be partitioned into two spaces of upper and lower side spaces. Moreover, it is made that the working fluid supplied to the hydraulic chamber flow passage 115 passes through the two spaces of the hydraulic chamber 128 partitioned thus. However, if the valve 7 is closed, the lower space of the two spaces of the hydraulic chamber 128 partitioned thus is not formed owing to movement of the valve cylinder 130.

The inner body 120 is provided coupled to, and slidable between, the outer body 110 and the valve cylinder 130. And, in order to supply the working fluid from the hydraulic pressure supply unit 3 to the latching member 150, 152, 154, the inner body 120 has a flow passage 126 formed recessed therein in a circumferential direction thereof to become in communication with the latching flow passage 114.

And, the inner body 120 has an outside surface formed slidable on an inside surface of the outer body 110 and an inside surface formed slidable on the valve cylinder 130. And, the inner body 120 has latching member receiving portions 124 formed on one side of the inside surface thereof at positions matched with a plurality of the latching members 150, 152, 154.

The inner body 120 has an upper side with a contact surface 129 formed to be in contact with a cam 9. And, as the cam shaft rotates, the cam 9 provided to the cam shaft pushes the contact surface 129 to make the inner body 120 to slide in a valve opening or closing direction.

The valve cylinder 130 has one side coupled to the body 110, 120, and the other side coupled to the valve 7, for opening or closing the valve 7 as the valve cylinder 130 moves with respect to the body 110 or the cylinder head.

The valve cylinder 130 has the latching member insert portion 134 for receiving the latching member 150, 152, 154 therein.

The valve cylinder 130 has a side of an upper side thereof sliding on an inside of the inner body 120 in a valve opening/closing direction, and a close contact portion 139 which is an outermost side of a lower side thereof sliding on an inside of a lower side of the outer body 110 in the valve opening/closing direction.

There is a hydraulic pressure lash unit 140 (HLU: Hydraulic Lash Unit) coupled between the valve 7 and a lower side of a central region of the valve cylinder 130. And, in order to make the valve 7 to maintain a fixed gap to the cam 9, the hydraulic pressure oil having a constant pressure is sealed in the hydraulic pressure Lash unit 140.

The latching member 150, 152, 154 moves selecting one of an unlocking position at which the latching member 150, 152, 154 couples to one of the body 110, 120 and the valve cylinder 130, and decouples from the other one of the body 110, 120 and the valve cylinder 130 and a locking position at which the latching member 150, 152, 154 couples to the other one of the body 110, 120 and the valve cylinder 130.

Accordingly, under the control of a control unit 10, the locking position or the unlocking position of the latching member 150, 152, 154 is selected, and the body 110 and the valve cylinder 130 slide on the cylinder head together, slide relatively, or the valve cylinder 130 does not move, according to rotation of the cam 9.

In the following description, a case in which the latching member 150, 152, 154 is coupled to the valve cylinder 130 will be described, typically.

The latching member 150, 152, 154 includes a latching pin 150 to slide coupled to the latching member insert portion 134, a latching spring 152 for pushing the latching pin 150 to one side, and a stopper 154 for preventing the latching pin 150 from moving from the latching member insert portion 134 excessively.

The latching spring 152 pushes the latching pin 150 to one side for the latching pin 150 to maintain the locking position. And, if the working fluid supplied from the hydraulic pressure supply unit 3 is introduced to the latching flow passage 114, the latching pin 150 is pushed by the hydraulic pressure. In this case, the hydraulic pressure which pushes the latching pin 150 thus overcomes force of the latching spring 152 making the latching pin 150 to maintain the unlocking position.

The hydraulic chamber 128 is formed between the body 110, 120 and the valve cylinder 130 for making the body 110, 120 to move as much as a basic stroke of a lift of the cam 9 according to rotation of the cam 9 in an open/close direction of the valve 7. In this case, the basic stroke of the lift of the cam 9 is called as a main stroke. And, the hydraulic chamber 128 is extended between the body 110, 120 and the valve cylinder 130 for making the valve 7 to move as much as a stroke amplified proportional to change of the stroke of the lift of the cam 9 in the open/close direction of the valve 7. In this case, the stroke amplified proportionally in the open/close direction of the valve 7 is called as an amplified stroke. In this case, an amount of the lift of the cam 9 and the main stroke of the outer body 110 are the same.

A ratio of the main stroke to the amplified stroke may be set within a range of 1:15~1:2.5 by a person of an ordinary skill in this field of art (hereinafter, a person of an ordinary skill in the art). If the ratio of the main stroke to the amplified stroke is larger than the range, a height is large in view of mechanism, and if smaller, an effect of the amplification may be weak.

Either the body 110, 120 or the valve cylinder 130 has a ramping protective portion 137 formed therein for preventing a sharp volume reduction of the hydraulic chamber 128 in a step of opening/closing of the valve 7 to a largest extent before the valve 7 is closed as the cam 9 rotates.

The hydraulic chamber flow passage 115 is in communication with an accumulator 30, selectively.

If the body 110 moves down in the valve opening/closing direction, the working fluid is transferred from the hydraulic chamber 128 to the accumulator 30 through the hydraulic chamber flow passage 115. And, the working fluid transferred to the accumulator 30 thus is stored therein while forming the constant hydraulic pressure.

The control unit 10 controls supply and removal of the working fluid supplied to the latching flow passage 114 or the hydraulic chamber flow passage 115 for enabling control of an opening or a closing of the valve 7 in association with the rotation of the cam 9. That is, the control unit 10 controls the hydraulic pressure supply unit 3, a working fluid control valve 20 and a latching oil control valve 50.

The working fluid control valve 20 is opened or closed selectively for storing the working fluid supplied from the hydraulic pressure supply unit 3 therein, and supplying the working fluid stored thus to the hydraulic chamber 128, selectively.

The working fluid control valve 20 is connected to a communication flow passage 60 and a supply flow passage 62.

The communication flow passage 60 makes the working fluid control valve 20 and the hydraulic chamber flow passage 115 to be in communication with each other. And, if the working fluid control valve 20 is opened, the working fluid, passed through the working fluid control valve 20, is supplied to the hydraulic chamber flow passage 115 through the communication flow passage 60. That is, the working fluid is supplied to the hydraulic chamber 128.

The supply flow passage 62 makes the hydraulic pressure supply unit 3 and the working fluid control valve 20 to be in communication with each other. That is, the working fluid is supplied from the hydraulic pressure supply unit 3 to the working fluid control valve 20 through the supply flow passage 62. And, a check valve 40 is arranged on the supply flow passage 62. The check valve 40 prevents the working fluid from flowing to the hydraulic pressure supply unit 3, reversely. In the meantime, the accumulator 30 is arranged on the supply flow passage 62 between the check valve 40 and the working fluid control valve 20.

The latching oil control valve 50 is opened or closed selectively for storing the working fluid supplied thereto from the hydraulic pressure supply unit 3 therein and supplying the working fluid stored thus to the latching member 150, 152, 154.

The latching oil control valve 50 is connected to a latching communication flow passage 64.

The latching communication flow passage 64 makes the latching oil control valve 50 and the latching member 150, 152, 154 to be in communication to each other. And, if the latching oil control valve 50 is opened, the working fluid, passed through the latching oil control valve 50, is supplied to the latching member 150, 152, 154 through the latching communication flow passage 64.

Hereinafter, the operation of the variable valve lift apparatus 100 in accordance with an exemplary embodiment of the present invention will be described.

The unlocking position of the latching member 150, 152, 154 is a state in which the latching pin 150 has been pushed to the latching member insert portion 134 of the valve cylinder 130 by the working fluid pressurized from the hydraulic pressure supply unit 3 and supplied to the latching flow passage 114 to overcome the pressure of the latching spring 152 such that the latching pin 150 does not couple to the inner body 120. In the meantime, no pressurized working fluid is supplied to the hydraulic chamber flow passage 115.

In other words, the control unit 10 puts the hydraulic pressure supply unit 3 into operation, and controls to open the latching oil control valve 50, and to close the working fluid control valve 20.

Therefore, if the cam 9 rotates, the inner body 110 moves as much as the main stroke with respect to the cylinder head and the valve cylinder 130 at a largest lift of the cam 9. In this case, since the valve cylinder 130 does not move, the hydraulic chamber 128 is not partitioned. And, the valve cylinder 130 is supported by the valve spring 160, elastically.

In the meantime, as the stroke of the hydraulic chamber 128 is increased, the working fluid moves from the hydraulic chamber 128 toward a side of the accumulator 30 which is in communication with the hydraulic chamber flow passage 115 to apply a pressure to an elastic region of the accumulator 30 to secure a space therein and to be received in the hydraulic chamber flow passage 115 at the constant pressure. Then, if the cam 9 rotates in a valve 7 close direction passed through a largest lift, the inner body 120 applies a pressure toward the cam 9 elastically owing to the working fluid stored in the hydraulic chamber flow passage 115 and the accumulator 30 at the constant pressure.

In this case, though the lift of the cam 9 and the main stroke of the inner body 120 are the same, since the valve cylinder 130 does not move, not to open the valve 7, it is a state there is no amplified stroke.

Then, if the latching member 150, 152, 154 moves to the locking position, since the working fluid pressurized from the hydraulic pressure supply unit 3 is not supplied to the latching flow passage 114, the latching pin 150 is coupled to the inner body 120 by the pressure of the latching spring 152, making the inner body 120 to move with the valve cylinder 130. In the meantime, no pressurized working fluid is supplied to the hydraulic chamber flow passage 115.

In other words, the control unit 10 puts the hydraulic pressure supply unit 3 into operation, and controls both the latching oil control valve 50 and the working fluid control valve 20 to be closed.

Therefore, if the cam 9 rotates, the inner body 110 moves as much as the main stroke with respect to the cylinder head at the largest lift of the cam 9, for the valve cylinder 130 and the inner body 120 to move down altogether in a state locked by the inner body 120 and the latching member 150, 152, 154. In this case, the valve cylinder 130 also moves to partition the hydraulic chamber 128. In the meantime, the valve cylinder 130 is supported by the valve spring 160, elastically.

As the stroke of the hydraulic chamber 128 increases, a portion of the working fluid in the hydraulic chamber 128 moves toward the accumulator 30 which is in communication with the hydraulic chamber flow passage 115 and is introduced to the hydraulic chamber flow passage 115 at the constant pressure. Then, if the cam 9 rotates in a valve 7 close direction passed through the largest lift, the inner body 120 has a pressure applied thereto toward the cam 9 elastically by the working fluid stored in the hydraulic chamber flow passage 115 and the accumulator 30 at the constant pressure. In this case, the contact surface 129 and the cam 9 may always be in contact.

In an exemplary embodiment of the present invention, the lift of the cam 9, the main stroke of the inner body and the amplified stroke of the valve cylinder 130 are the same, and the valve cylinder 130 is opened as much as the lift of the cam 9.

Next, the unlocking position of the latching member 150, 152, 154 is a state in which the latching pin 150 is coupled to the inner body 120, and relative sliding between the inner body 120 and the valve cylinder 130 is possible as the working fluid pressurized from the hydraulic pressure supply unit 3 is supplied to the latching flow passage 114 to overcome the pressure of the latching spring 152. In the meantime, the working fluid pressurized thus is supplied to the hydraulic chamber flow passage 115.

In other words, the control unit 10 puts the hydraulic pressure supply unit 3 into operation and controls both of the latching oil control valve 50 and the working fluid control valve 20 to be opened.

Therefore, if the cam 9 rotates, the inner body 120 moves as much as the main stroke with respect to the cylinder head at the largest lift of the cam 9, and the valve cylinder 130 moves from an upper side to a lower side of the hydraulic chamber 128 having the working fluid partitioned therein thus following the moving down of the inner body 120 in a state unlocked by the inner body 120 and the latching member 150, 152, 154.

The variable valve lift apparatus 100 in accordance with an exemplary embodiment of the present invention includes an oil removal valve 80.

Before starting description of a configuration and a function of the oil removal valve 80, the ramping preventive portion 137 and the close contact portion 139 of the valve cylinder 130 are formed with a step, and if the valve cylinder 130 moves down, a space is formed between a stepped portion between the ramping preventive portion 137 and the close contact portion 139 and the outer body 110. And, if the valve cylinder 130 moved down thus moves up to a certain extent, the space formed between the stepped portion between the ramping preventive portion 137 and the close contact portion 139 and the outer body 110 becomes to have an enclosed shape. In this case, even if there is a gap between the outer body 110 and the valve cylinder 130, the fluid present in the enclosed shape interferes with smooth rise of the valve cylinder 130.

In other words, a rate of the leakage of fluid present in the enclosed shape to an outside thereof through a gap between the outer body 110 and the valve cylinder 130 may be lower than a rate of the rise of the valve cylinder 130 leading the fluid to form a hydraulic pressure in the enclosed shape. Therefore, the hydraulic pressure formed in the enclosed shape may interfere with the rise of the valve cylinder 130 to make responsiveness of the rise poor. Particularly, as the viscosity of the fluid supplied to the variable valve lift apparatus 100 becomes high at the same time with drop of the temperature of the fluid in a state the engine temperature is low, the responsiveness of the rise of the valve cylinder 130 may become poorer.

The oil removal valve 80 functions to make the fluid to flow out of the enclosed shape, smoothly. The oil removal valve 80 includes a supporting portion 82, an active portion 84, a return spring 86, a bypass flow passage 88, an active flow passage 116, a recovery flow passage 117, and a flow out flow passage 119.

The supporting portion 82 is mounted, and secured, to the outer body 110.

The active portion 84 is provided to a top side of the supporting portion 82 to be movable in up and down directions. And, the active portion 84 is formed to have a column shape with an upper end, a lower end and a side.

The return spring 86 is arranged between the supporting portion 82 and the active portion 84. And, the return spring 86 is supported on the supporting portion 82 for pushing the active portion 84 upward.

The bypass flow passage 88 is formed in the active portion 84. And, the bypass flow passage 88 has one end opened to the low end of the active portion 84 and the other end opened to the side of the active portion 84. Therefore, the one end of the bypass flow passage 88 is in communication with a space between the supporting portion 82 and the active portion 84.

The active flow passage 116 is formed in the outer body 110 for making the latching flow passage 114 to be in communication with the upper end of the active portion 84.

The recovery flow passage 117 is formed in the outer body 110 so as to be in communication with the hydraulic chamber 128.

The flow out flow passage 119 is formed in the outer body 110 so as to be in communication with the enclosed shape of space formed between the stepped portion of the ramping preventive portion 137 and the close contact portion 139 and the outer body 110.

The operation of the oil removal valve 80 will be described.

If the working fluid is supplied to the latching flow passage 114, the working fluid is supplied from the latching flow passage 114 through the active flow passage 116 to push the upper end of the active portion 84. And, if the active portion 84 is pushed downward, the recovery flow passage 117 and the flow out flow passage 119 are closed.

If the supply of the working fluid to the latching flow passage 114 is removed, or if the working fluid is drained to an outside of the outer body 110 through the latching flow passage 114, the hydraulic pressure of the working fluid which presses the upper end of the active portion 84 is removed. That is, the active portion 84 moves upward by the return spring 86. In this case, the flow out flow passage 119 is in communication with the space between the supporting portion 82 and the active portion 84, and the recovery flow passage 117 is in communication with the other end of the bypass flow passage 88. Accordingly, the fluid present in the enclosed shape of space is recovered to the hydraulic chamber 128 passed through the flow out flow passage 119, the space between the supporting portion 82 and the active portion 84, the bypass flow passage 88, and the recovery flow passage 117 in succession.

Thus, according to an exemplary embodiment of the present invention, in a case the engine temperature is low, operation reliability and stability can be enhanced. And, operation responsiveness can be improved and smooth opening and closing of the valve 7 can be embodied.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. They are not intended to be exhaustive or to limit the invention to the precise forms disclosed, and obviously many modifications and variations are possible in light of the above teachings as well as various alternatives and modifications thereof. It is intended that the scope of the invention be defined by the Claims appended hereto and their equivalents.

What is claimed is:

1. A variable valve lift apparatus comprising:

an outer body coupled to a cylinder head arranged between a cam and a valve;

an inner body inserted in the outer body to move up and down in the outer body according to rotation of the cam;

a valve cylinder inserted in the outer body on a lower side of the inner body to have a first side coupled to the inner body and a second side coupled to the valve for moving up and down on an inside of the outer body;

a latching member provided either to the outer body or to the inner body to be operated by a hydraulic pressure for selectively coupling to the outer body and the inner body;

a hydraulic chamber formed between the outer body and the inner body and moving the inner body as much as a stroke of a lift of the cam with a hydraulic pressure;

a latching flow passage formed in the outer body to supply the hydraulic pressure to the latching member; and an oil removal valve provided to drain a fluid from a space formed between the outer body and the valve cylinder or the inner body depending on a shape of the inner body or the valve cylinder at a time the inner body or the valve cylinder moves up and down, wherein the oil removal valve includes:

a supporting portion mounted to the outer body;

an active portion formed to have a column shape with an upper end, a lower end and a side provided to a top side of the supporting portion to be movable up and down;

a return spring supported by the supporting portion arranged between the supporting portion and the active portion for pushing the active portion upward;

a bypass flow passage formed in the active portion to have a first end opened to the lower end of the active portion, and a second end opened to the side of the active portion;

an active flow passage formed in the outer body to make the latching flow passage and the upper end of the active portion to be in communication;

a flow out flow passage formed in the outer body to be in communication with the space and in communication with the bypass flow passage, selectively; and a recovery flow passage formed in the outer body to be in communication with the hydraulic chamber and in communication with the bypass flow passage, selectively.

2. The variable valve lift apparatus of claim 1, wherein the flow out flow passage and the recovery flow passage are closed when the upper end of the active portion is pushed by the hydraulic pressure supplied from the active flow passage.

3. The variable valve lift apparatus of claim 2, wherein the upper end of the active portion has the hydraulic pressure supplied thereto from the active flow passage when the hydraulic pressure is supplied to the latching flow passage.

4. The variable valve lift apparatus of claim 1, wherein, when the hydraulic pressure being supplied to the active portion is removed, the active portion is returned to an original position by the return spring.

5. The variable valve lift apparatus of claim 4, wherein, when the active portion is returned to the original position, the flow out flow passage and the recovery flow passage become in communication with the bypass flow passage.

6. The variable valve lift apparatus of claim 5, wherein the flow out flow passage becomes in communication with a space between the active portion which is to become in communication with the first end of the bypass flow passage and the supporting portion.

7. The variable valve lift apparatus of claim 5, wherein the recovery flow passage becomes in communication with the second end of the bypass flow passage.

* * * * *